US009453392B1

(12) United States Patent
Marchiori

(10) Patent No.: US 9,453,392 B1
(45) Date of Patent: Sep. 27, 2016

(54) RAPID INSTALL ENVIRONMENTAL TRAY

(71) Applicant: David Marchiori, San Antonio, TX (US)

(72) Inventor: David Marchiori, San Antonio, TX (US)

(73) Assignee: D Ring Solutions, LLC, San Antonio, TX (US)

( * ) Notice: Subject to any disclaimer, the term of this patent is extended or adjusted under 35 U.S.C. 154(b) by 481 days.

(21) Appl. No.: 13/888,348

(22) Filed: May 6, 2013

Related U.S. Application Data

(60) Provisional application No. 61/642,997, filed on May 4, 2012.

(51) Int. Cl.
*E21B 33/08* (2006.01)
*E21B 41/00* (2006.01)
*E21B 21/01* (2006.01)

(52) U.S. Cl.
CPC ..... *E21B 41/00* (2013.01); *E21B 21/01* (2013.01); *E21B 33/08* (2013.01)

(58) Field of Classification Search
CPC ..... E21B 33/08; E21B 21/01; E21B 33/03; E21B 41/00; E21B 43/0122; Y10T 137/5762
USPC ..... 166/81.1, 379; 137/312
See application file for complete search history.

(56) References Cited

U.S. PATENT DOCUMENTS 1,863,211 A * 6/1932 Wimmer ..... E03D 1/01 4/251.2
2,214,429 A * 9/1940 Miller ..... E21B 21/01 166/81.1
2,509,881 A * 5/1950 Qualheim ..... E03D 1/01 4/251.2
2,599,502 A * 6/1952 Wanke ..... E03D 1/01 4/251.2
4,949,784 A * 8/1990 Evans ..... E21B 34/02 166/165
5,121,796 A * 6/1992 Wigington, Sr. ..... E21B 21/01 166/379
5,167,277 A * 12/1992 Evans ..... E21B 33/08 166/81.1
5,228,506 A * 7/1993 Pearce ..... E21B 33/08 166/81.1
5,343,943 A * 9/1994 Norris ..... E21B 21/01 166/81.1
5,351,753 A * 10/1994 Golson ..... E21B 33/08 166/107
5,377,748 A * 1/1995 Gayaut ..... E21B 33/08 166/162
5,477,920 A * 12/1995 Simmons ..... E21B 33/08 166/81.1
5,551,511 A * 9/1996 Holtby ..... E21B 21/106 166/81.1
5,634,485 A * 6/1997 Holtby ..... E21B 21/01 137/15.01
5,937,947 A * 8/1999 Holtby ..... E21B 33/03 166/379
6,102,086 A 8/2000 Holtby
6,286,593 B1 * 9/2001 Holtby ..... E21B 33/03 137/15.08
6,386,225 B1 * 5/2002 Holtby ..... E21B 33/08 137/15.01
6,666,287 B2 12/2003 Holtby
7,987,904 B1 * 8/2011 Rose ..... E21B 33/03 166/381
8,613,373 B2 12/2013 Holtby et al.
8,910,803 B2 12/2014 Holtby et al.
9,353,580 B2 5/2016 Holtby et al.
2012/0138312 A1 * 6/2012 Strong ..... E21B 33/072 166/377

OTHER PUBLICATIONS

Advanced Fluid Technologies, Kelly Kan, advertisement; http://advanced-fluid-technologies.com/product1A.htm; Dec. 2, 2014.

* cited by examiner

*Primary Examiner* — Daniel P Stephenson
(74) *Attorney, Agent, or Firm* — William H. Quirk; Jesse L. Frizzell; Rosenthal Pauerstein Sandoloski agather LLP

(57) ABSTRACT

A bop tray and related method for providing fast and effective containment of various wellhead liquids above and around the high drill assembly of a hydrocarbon wellhead blowout preventer.

26 Claims, 8 Drawing Sheets

RAPID INSTALL ENVIRONMENTAL TRAY

NONPUBLICATION REQUESTED

This application is a non-provisional application under 37 CFR 1.53(b) and is submitted with an accompanying non-publication request in accordance with 35 U.S.C. §122(b). Accordingly, non-publication is requested, and the subject matter of this application is to be maintained in secrecy until and unless Applicant allows a patent to issue based on this application.

CLAIM OF PRIORITY TO PRIOR APPLICATION

The present application claims the benefit of prior filed U.S. Provisional Application, Ser. No. 61/642,997, filed May 4, 2012. By this reference, the full disclosure, including the drawings, of U.S. Provisional Application, Ser. No. 61/642,995, is incorporated herein as though now set forth in its entirety.

BACKGROUND OF THE INVENTION

1. Field of the Invention

The present invention relates to blowout preventer drip trays in the field of hydrocarbon drilling rigs. More particularly, the invention relates to annular bop trays of the type that are installed around a wellhead stem pipe above the high drill of its blowout preventer, to catch and contain liquids, as are useful for environmental containment and/or re-use of liquids that leak from or are applied to the wellhead, or that otherwise spill from and around the wellhead.

2. Description of Related Art

A blowout preventer drip tray—a "bop tray"—is a liquid containment tray that has been used for several decades in oilfield drilling, production and work-out. Bop trays are mounted around the wellhead stem pipe beneath the blowout preventers. Largely for environmental purposes, they function to catch and contain potentially hazardous oilfield liquids spilling from the wellhead. As is fairly well-known, liquid spills on the ground around a wellhead can be expensive to clean up.

Structurally, the basic part of a conventional bop tray is a circular pan, with an up-turned circumferential rim to help contain the captured liquids. The trays typically have a central hole through which the wellhead stem pipe extends, and they often mount above or below one or more wellhead collars and/or flanges that are connected to the wellhead stem pipe. One popular bop tray is marketed as the "Katch Kan," versions of which have been commercially available since the early-to-mid-1990's.

For ease of installation, conventional bop trays come in two, substantially-symmetrical, semicircular halves. The two halves are positioned on horizontally opposite sides of the wellhead and then bolted together around the wellhead to catch and contain liquids. Such conventional bop tray designs serve the basic functions reasonably well, but it is accepted that it takes up to an hour or so to properly install conventional bop trays. Not only is there a labor and work stoppage expense associated with the amount of time required, but usually the need to catch the liquids is imminent when the bop tray is being installed, which increases the risk of a worsening clean-up problem while the crew is installing the bop tray.

Additionally, currently available containment trays suffer from a significant limitation in that the amount of pressure which may be exerted on the combined halves and on the well head section enclosed is limited by the bolt type fasteners used to secure the two halves together.

The liquids caught by bop trays might include everything from leaking oil to cleaning solutions, as well as drilling mud, brine and other hydraulic fluids, most of which are both potentially hazardous as well as costly. Remediation/clean-up expenses and environmental impacts of inadequate containment of the liquids can be enormous. Moreover, when the spilled liquids are valuable, bop trays also allow for capture, sale and/or re-use of the liquids that leak from or are applied to the wellhead. Only a little liquid might spill during each drill string connection, but the cumulative costs of spilled liquids can be substantial over the duration of a drilling operation. Accordingly, many bop trays are provided with slots or holes to accommodate surrounding structures, such as hoses to recirculate the liquids or to direct the captured liquids into appropriate tanks.

Irrespective of the detailed approaches of the prior art, there remains a long-felt need to better capture, contain and manage liquids spilling around a wellhead. Moreover, with bop trays specifically, there has been a long-felt need for a bop tray that is both highly functional and dependable while also being faster and easier to install and use, yet oilfield tool manufacturers and support services have not been able to adequately address such needs.

SUMMARY OF THE INVENTION

To be encompassing at the outset, the present invention can be summarized as improvements over the prior art that will be evident to those of skill in the art from a thoughtful and comprehensive review of the following descriptions and accompanying drawings in light of that prior art, all to the extent those improvements are patentable. The present invention will ultimately be defined relative to one or more patent claims or groups of claims that may be appended to this specification or to specifications that claim priority to this specification, as those claims may be amended, divided, refined, revamped, replaced, supplemented or the like over time. Even though the corresponding scope of the invention depends on those claims, these descriptions will occasionally make references to the "invention" or the "present invention" as a matter of convenience, as though that particular scope is already completely understood at the time of this writing. Indeed, multiple independent and distinct inventions may properly be claimed based on this specification, such that reference to the "invention" is a floating reference to the subject matter defined by the ultimate form of the corresponding patent claims. Accordingly, to the extent these descriptions refer to aspects of the invention that are not separately required by the ultimate patent claims, such references should not be viewed as limiting or as describing that expression or variation of the invention.

That said, a basic objective of the present invention is to improve over the prior art. To that end, it is an object of the present invention to provide or enable an annular drip tray in the field for reducing the quantity of potentially hazardous fluids leaking on the ground. Another object of the present invention is to enable cost-effective reduction of liquid loss and environmental contamination from wellheads and related operations. Other objects are to minimize direct and indirect costs and to reduce the risk of injury to oilfield personnel.

It is also an object of the invention to provide a fast and effective configuration for a liquid containment tray that allows rapid installation around wellhead structures at locations where spilled liquids can be efficiently captured. It is also an object to enable installation of bop trays with fewer personnel than with alternative solutions.

Other objects of the invention include the provision of an annular drip tray for capture of liquids above the high drill of a drilling rig blowout preventer, both for environmental containment and for keeping the high drill relatively clean during drilling operations. Related objects include the enablement of a reliable system for rapid installation of wellhead drip trays and, more particularly, for rapid installation of an effective bop tray with only one or fewer latches or the like. Other objects include the provision of solutions that are safe, effective, and environmentally friendly.

Many other objects, features and advantages of the present invention will become apparent to those of skill in the art from the remainder of these descriptions. It should be understood, however, that the detailed description and the specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

For a more complete understanding of the present invention and its preferred embodiments, and the advantages thereof, reference is now made to the following descriptions taken in conjunction with the accompanying drawings, in which.

DETAILED DESCRIPTION OF PREFERRED EMBODIMENTS

An understanding of various preferred and alternative embodiments can be gleaned from a review of this description and the accompanying illustrations, wherein attempts are made to use like numerals for similar and/or analogous components from one subsystem to another and from one embodiment to another, all of which should be considered in light of the many teachings of the prior art.

Alternative preferred embodiments are occasionally described or illustrated in paragraphs, sentences or drawings that are separate from those for other preferred embodiments. Most alternative preferred embodiments, however, are described in the context of a sentence or group of sentences merely by reference to one or more alternatives for an individual component or step, as may or may not be set apart by parentheses. The reader should understand that, whenever alternative components, steps or the like are referenced in this latter manner (or in any manner), each such alternative component, step or the like may be used in virtually any combination where the other alternatives are described, illustrated or implied as being used, except perhaps to the extent that one of ordinary skill in the art would clearly recognize that such other combinations would not result in any of the structure, functionality, objectives or purposes of the present invention as ultimately claimed.

Although many secondary details, optional structures, optional features, variations and alternatives are not illustrated or described here, they should be evident to one of ordinary skill in the art from the aspects of the preferred embodiments that are depicted and described with reference to FIGS. 1-6, particularly when considered in light of the prior art and any claims (including amended claims) that may be appended to this application and/or subsequent applications referencing this application.

Figure 1:
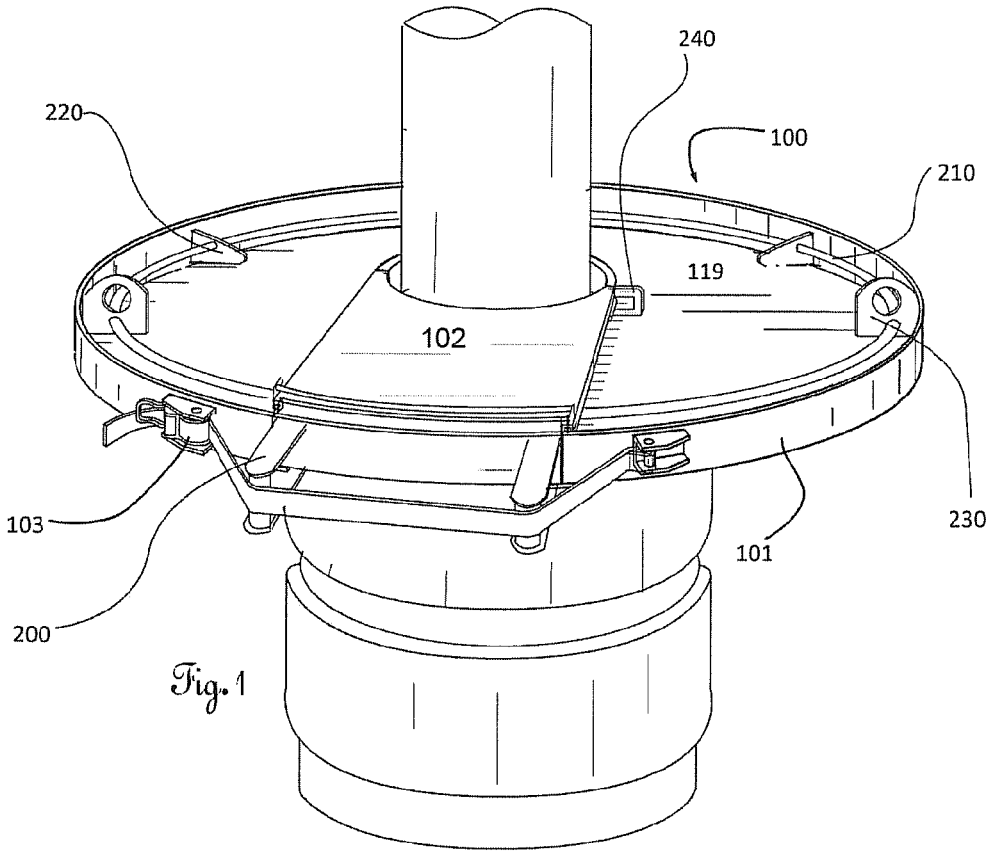
FIG. 1 is a bird's-eye perspective view of a system that embodies, incorporates and uses the present invention, for accomplishing objects of the present invention, including enabling the rapid installation of a bop tray 100 around a wellhead.

With reference to FIG. 1, many aspects of the invention may be embodied as an annular assembly that forms bop tray 100, and other aspects of the invention are enabled and appreciated when such a bop tray 100 is installed and used surrounding a wellhead 500, preferably in a position above the high drill of the wellhead's blowout preventer.

Bop tray 100 provides, in one embodiment, a finished annular drip tray that is preferably provided by two basic parts—a C-shaped main part 101 and a closure portion 102. The closure portion 102 preferably fits into a radially-oriented slot 120 in the main part 101, in a drawer-like sliding fashion. Closure portion 102 has engaging portions that are, in turn, slightly wider that slot 120 to allow structural overlap of those surfaces so that portion 102 is supported by the overlapped structures of main part 101.

Slot 120 is preferably as wide or slightly wider that the diameter of the wellhead stem pipe about which the bop tray 100 is to be installed. Both the closure portion 102 and the slot 120 in which portion 102 fits preferably have parallel side edges that are separated enough that the pipe stem diameter is less than the width of the slot 120. Those of ordinary skill in the art will appreciate, however, that other mechanisms and orientations may be substituted for engaging the closure portion 102 relative to the main part 101 as alternatives.

Once the main part 101 is operatively positioned relative to a wellhead 500, and once the closure portion 102 is then inserted in slot 120, the two parts 101, 102 cooperate to define the finished annular tray for catching and containing liquids spilling around a wellhead 500. Although the illustrated embodiments present a circular outer shape for bop tray 100, a person of ordinary skill in the art would immediately recognize that other, non-circular tray configurations would be suitable while still embracing certain other aspects of the invention.

Bop tray 100 has a drawer type closure and uses a single closure mechanism—which in the preferred embodiment is comprised of ratchet strap 103—to squeeze and hold the drawer into the coupling with the stem pipe 501. In the preferred embodiment, the strap additionally courses over and leverages against the extended protrusions 200 located on the drawer insert so as to apply continued pressure on the drawer when ratcheting the strap tighter. Although the protrusions may be omitted in less preferred alternatives, the leveraged configuration provided by such protrusions 200 allows an operator to periodically increase pressure on the drawer insert to maintain the inner annular margin in a sealed configuration against the well head, thereby reducing the size of the inner aperture to ensure a tighter seal around the wellhead. Bracket 109 is for attaching ratchet strap to hold the drawer-like closure portion 102 inward within slot 120.

Silicon may be used around the inner lip of opening 107 to seal it up around the well head pipe 500, with or without a rubber gasket or other compressible spacer material. Bop tray 100 of the currently most preferred embodiment has a six to eight-foot outer diameter and a two-foot (23.5") inner diameter; the bottom is 3/16 aluminum plate and the sides are ¼"×4" aluminum which is either rolled from the floor or is welded to the floor. While these dimensions apply to the preferred embodiment, a person of reasonable skill in the art would recognize that other dimensions perform similar functions and would be obvious. The top of drawer has aluminum angles turned down so all the fluid drains to either one of the 4" npt outlets.

In use, although hoists, braces and/or a second crewman can be helpful, a properly trained and experienced service technician can install bop tray 100 by him/herself in less than five minutes. Installation requires positioning and (usually) temporarily bracing the main tray 101, while then inserting and securing drawer 102 in its operative position. The technician then ensures that the bop tray 100 is properly installed and that all related fluid management lines and tanks are connected and functioning properly. Weldment lugs 230 provide points for attachment of a crane, lift or other device to assist the operator in lifting and placing the unit. On-site maintenance personnel are preferably trained to ensure the liquid does not overflow or otherwise leak from bop tray 100 during its subsequent use. Such rapid installation and use of bop tray 100 allows a wellhead operation to prioritize environmental protection, safety and liquid containment, thereby reducing overall cost of wellhead operations. Preferably, this is accomplished while also ensuring compliance with all contractual and/or regulatory requirements throughout preparation, use and removal of bop tray 100.

The main part (or "main tray") 101 is preferably larger than the secondary drawer part (or "drawer" or "drawer tray") 102. When viewed from above (in its operative orientation), the operative combination of drawer 102 and main tray 101 define an annular-shaped liquid collection tray 100, preferably having a circular outer perimeter and a circular inner opening 107 for fitting closely around the pipe stem of a wellhead 500. Although alternative embodiments achieve the substantial equivalent in other ways, the circular inner opening 107 is preferably defined half by the main tray 101 and half by the drawer tray 102, such that each part 101, 102 has a semicircular inner surface for close positioning around the wellhead stem pipe 50*t* When fully installed in its operative position, preferably, any space between the circular opening 107 and the wellhead stem pipe 501 is sealed to minimize leakage of liquid through opening 107. Such seal may be provided by commercially available compounds such as silicone of a type that will withstand the presence of the target liquids without serious degradation.

Alternative embodiments may use other central seal arrangements such as O-rings, bushings or other types of seals that may be suitable. In one of the preferred embodiments, an effective seal is obtained by the use of a rubber skirt band which is installed and affixed to the inner annular margins of the assembly and which is situated between the inner upturned edge margins of the assembled unit and the pipe casing. In this embodiment, the skirt is comprised of a natural rubber that is approximately ¼ inch thick and 4 inches wide, although a person of skill in the art would immediately recognize that other materials and dimensions would produce the same results.

Main tray 101 has a radially-oriented slot 120 for receiving the part 102 that completes its annular shape. In the preferred embodiment, the drawer aligns with the sidewalls of the main tray through a u type channel located along the upper peripheral edges of the drawer. Although other slot configurations may be equivalent, the margins of slot 120 are preferably parallel to one another. The main tray 101 has a somewhat horseshoe shape when viewed from above, with a floor 119 and sides 116. Drawer like section 102 slides into a radially-oriented cavity in main tray 101 to complete a circular tray. A strap 103 provides force to push and retain drawer 102 in the cavity. In the preferred embodiment, the strap rides along mounting lugs 200 which extend radially outward from the outer peripheral edge of the drawer unit and which allow additional pressure to be exerted on the drawer unit to keep it aligned with the well head assembly it encloses. This allows the operator to exert increased pressure on the assembly by operating the ratcheting mechanism. The combination of drawer part 102 enables rapid installation of a functionally effective bop tray 100 around wellhead 500.

A ring 210, which is attached to the main tray via weldments 220 allows the attachment of a tarp type curtain so as to further contain ejected fluids. Attachment point lugs 230 are provided so that the unit may be lifted into place and positioned by the use of mechanical means. In the preferred embodiment, alignment lugs 240 provide a means for mating lugs located on the tray insert to align the drawer sub-unit with the main tray on insertion.

In one embodiment, the inner annulus of the assembly is sized to accommodate a relatively large pipe casing, bop flange or other component and inserts which are preferably comprised of a ultra high molecular weight (UHMW) plastic or other suitable material are placed between the inner annular edge and the pipe casing or other component in order to accommodate components of different sizes giving the tray assembly a universal fit. In this embodiment, the UHMW plastic insert is comprised of two halves or parts which may be inserted in place around the pipe casing, although other configurations of these components would be obvious to a person of skill in the art. In the illustrated embodiment, the plastic insert comprises two semi-circular units, each unit further comprising an upper and lower semi-annular plate to which seals such as o-ring materials which are resistant to hydrocarbons are attached. The upper and lower halves of the illustrated insert unit are held in approximation to each other by the use of nuts and bolts which pass through the upper and lower units and through multiple inserts which maintain the distance separation between the upper and lower halves uniting to form a bushing-like spacer between the inner annular surface of the bop tray and the outer surface of the wellhead stem.

Figure 2:
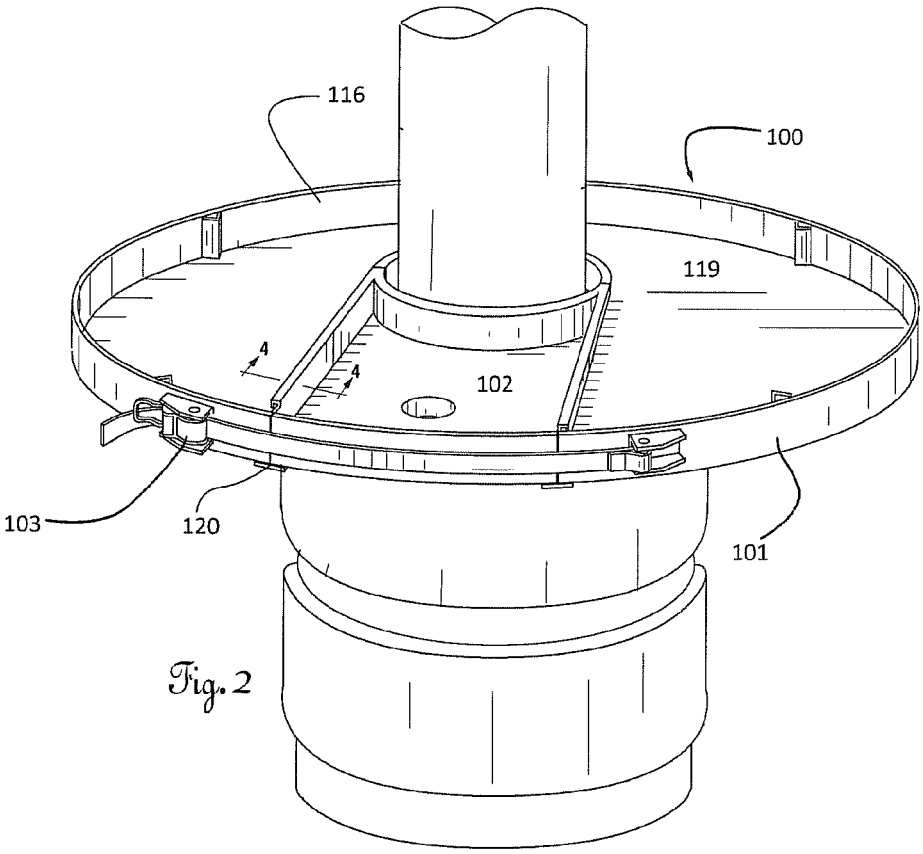
FIG. 2 shows an alternate embodiment of the bop tray around a well head.

FIG. 2 shows an alternate embodiment comprising a pan-type tray insert wherein the edge margins of the insert are upturned so as to for a tray with a floor in alignment with the floor of the main tray unit. Additionally, an alternate embodiment for attachment of drip curtain via weldment lugs is illustrated.

Figure 3:
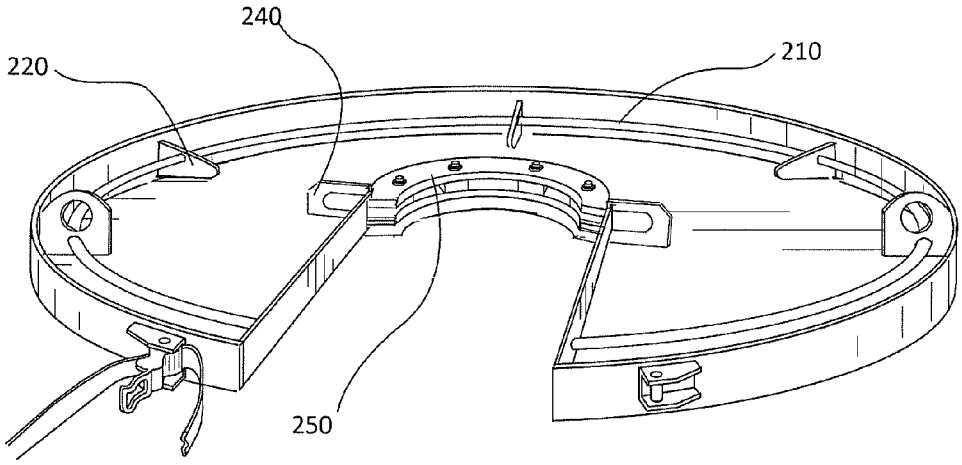
FIG. 3 shows a bird's-eye perspective view of a main portion 101 of the preferred embodiment of bop tray 100 shown in FIG. 1, with its secondary portion (drawer 102) removed, exposing wall 112 and tongue and groove ring 107.
Figure 7:
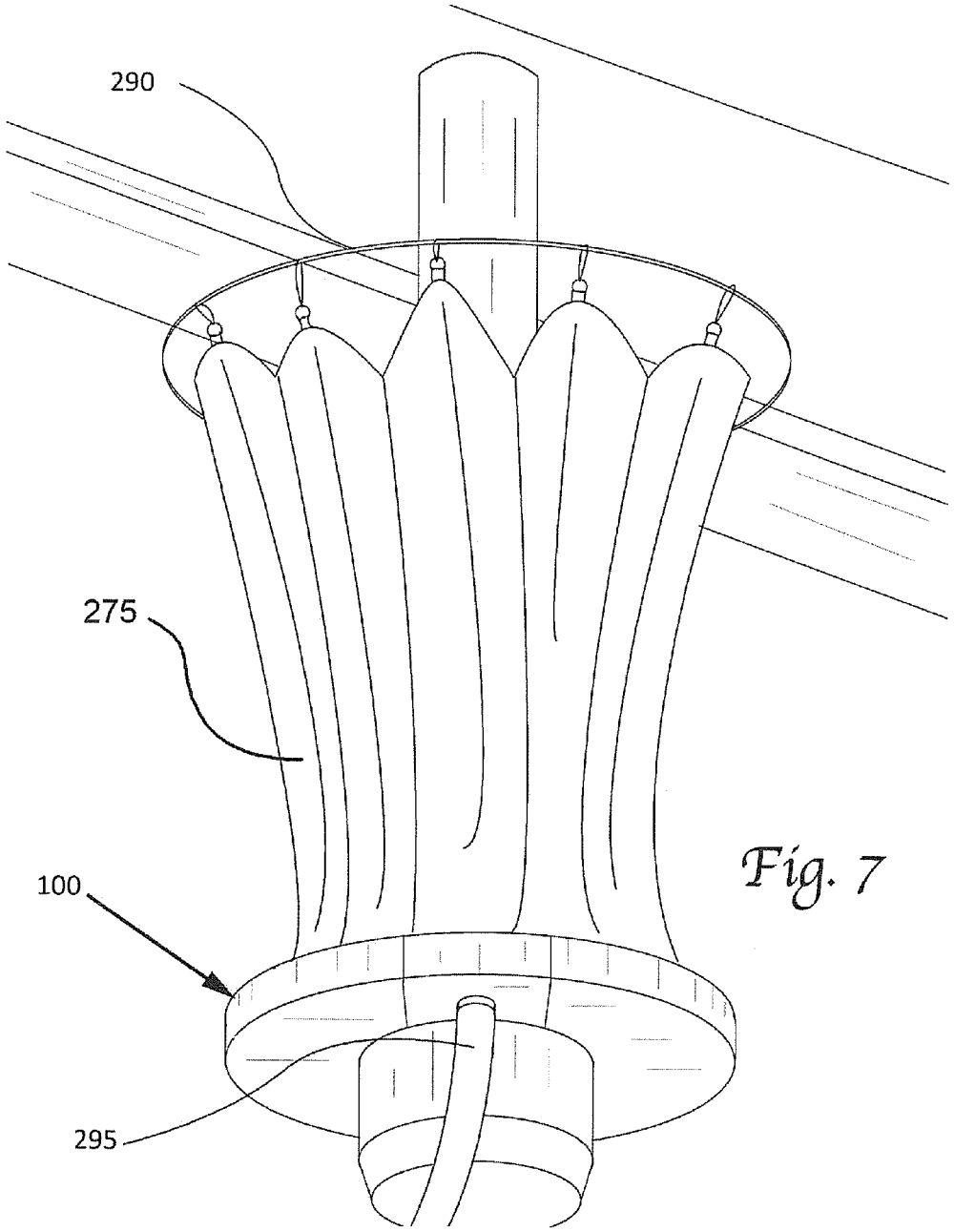
FIG. 7 shows an embodiment wherein a drip containment curtain is employed.

FIG. 3 shows a bird's-eye perspective view of the main tray 101 of the bop tray 100, with the drawer 102 removed, exposing wall 112 and tongue and groove ring 107B. Opening 106 is a drain fitting to attach a hose to the bottom for fluid to run off into a container. In a preferred embodiment, fixture ring 210 enables the attachment of a splash curtain which further directs discharged fluids into the bop tray for recovery. In the illustrated embodiment, the splash curtain assembly comprises a fixture ring 210; an independent upper ring 290 (FIG. 7) and a custom fabricated trap type curtain 275 (FIG. 7). In operation, a worker using the illustrated embodiment attaches the upper ring to the main frame assembly of the derrick or other drilling unit using available means such as c-clamps, wire ties, or plastic zip-ties, to suspend the ring in a position that is directly above the bop pan assembly 100. A custom curtain is then fabricated from available tarp material on-site that is sized so as to bridge the upper and lower attachment rings when in operation. The worker then attaches the tarp curtain to the upper independent ring and the lower integrated bop pan ring 108 using available means such as plastic zip ties.

In the illustrated embodiment, an insert 250 is shown in place immediately above the inner annular flange 280. This insert, which in preferred embodiments is comprised of a Ultra High Molecular Weight plastic of a type that is resistant to fluids encountered in drilling operations, is comprised of at least one sealing ring of a type of material commonly found in 0 rings. The illustrated embodiment illustrates an upper and lower sealing ring section, but a person of skill in the art would appreciate that other configurations are obvious.

Figure 4A:
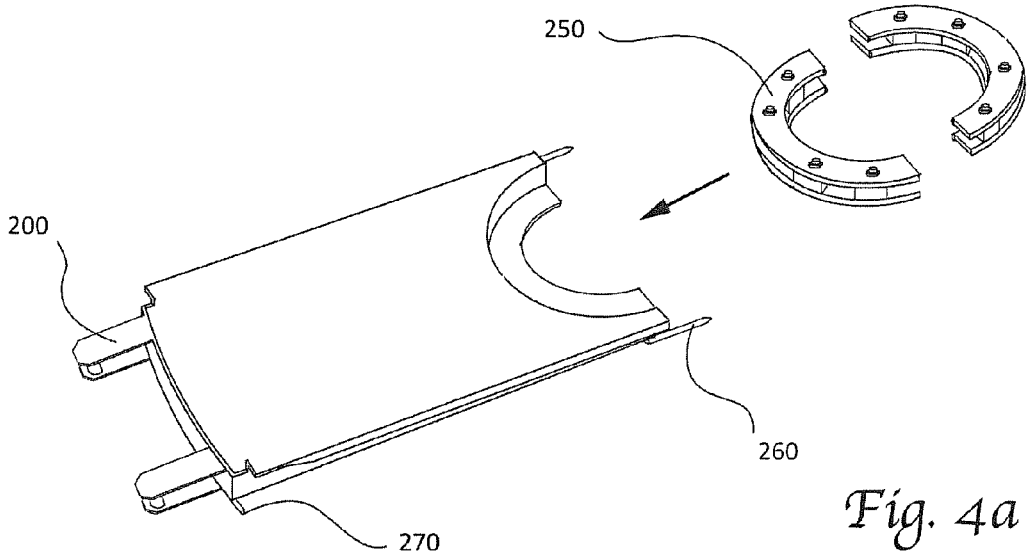
FIG. 4A shows an inverted bird's-eye perspective view of drawer 102 removed from tray 100 as well as an embodiment of inner annular inserts.

FIG. 4A is a bird's eye view of the inverted lid embodiment of the smaller tray unit. In this preferred embodiment, the tray subunit attaches to the main unit via alignment and stabilizing lugs 260 and 270 which engage the larger pan sub-unit as the insert tray is slidably inserted into position. In the illustrated preferred embodiment, the inverted tray comprises a cover sheet which may be of aluminum, which extends from left to right across the entire dimension of the tray assembly. When installed in the larger main tray subunit, the cover sheet of the drawer bridges the channel of the main tray and engages the upturned edges of said main tray channel via a downturned lip extending along the upper left and right margins of drawer-like closure portion 102.

In the illustrated embodiment, flanges 280 and 285 capture the wellhead flange typically positioned above the high drill assembly of the blowout preventer. Flange 285 is located at the interior annular end of the tray insert and engages a slot formed in mating pipe flange sections upon installation of the assembly. In such position, the flange 280 serves primarily to stabilize and index the location of the bop tray 100 relative to the wellhead flange, as is also the case for an oppositely extending flange. This flange is illustrative of one embodiment and is in no way limiting upon the scope of the invention as other embodiments may lack said flange in order to accommodate particular aspects of drilling operations.

Figure 4B:
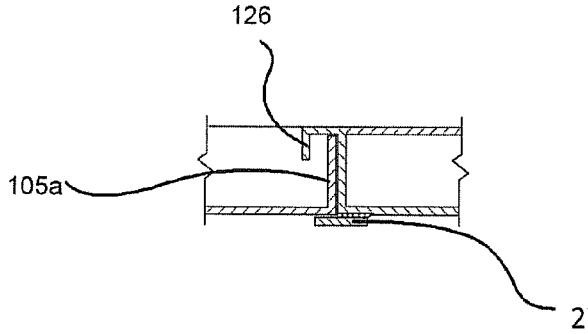
FIG. 4B is a rough detail view, in cross-section (along section line 4-4 designated in FIG. 1), of the left wall 105 of drawer 102, to illustrate flange configurations that provide fluid containment despite the removable relationship between the drawer 102 and the main portion 101 of bop tray 100.

FIG. 4B is a detail cross-sectional view of the left wall 105*a* of drawer 102, to illustrate flange configurations that provide fluid containment between slot 120 of main tray 101 and drawer 102. In some embodiments, the sheet forming the floor 114 of drawer 102 has a turned angle piece 105 at its left edge 105*a* and its right edge 105*b* to provide umbrella groove 126 on each side. In other embodiments, the horizontal sheet member comprises a lid or cover of the tray insert instead of a floor. Lug 270 is a weldment which, in the illustrated non-limiting embodiment provides an additional attachment between main tray 101 and drawer 102.

Figure 5:
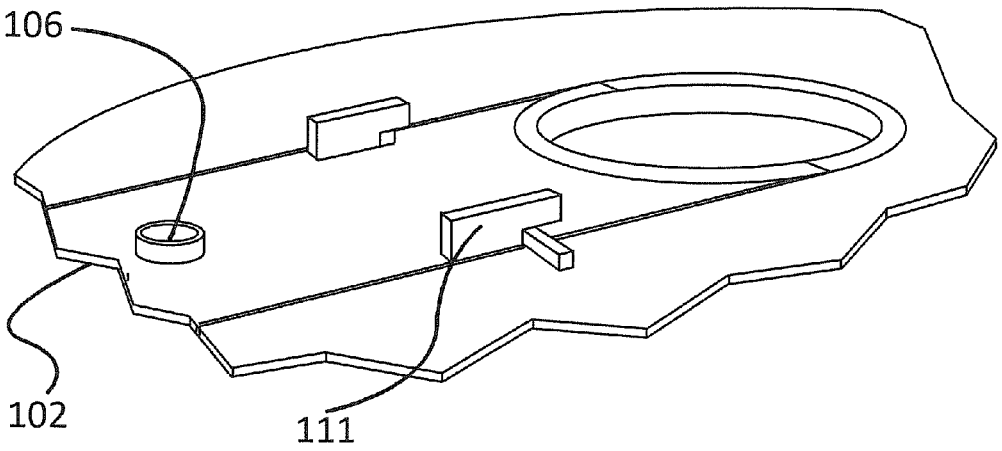
FIG. 5 shows a perspective view of an embodiment of tray 100 in an inverted orientation, to show its underside and the underside of its various parts.

FIG. 5 shows a view of bop tray 100 in an inverted orientation with an alternate embodied means of securing drawer to the main unit. In this particular embodiment, Drawer 102 is shown removed from tray and where 111 is an inward and bottom lug and configuration 110 allows for the drawer to be slid into cavity and keep drawer on the same plane. Drain fitting 106 provides a point for connection of a drain hose or other configuration suitable for draining of the pan. In other embodiments illustrated in FIG. 4A, drawer tray is aligned to main tray with a mating lug 260 and flange 240 (FIG. 1). Mating lugs 260 are weldably attached to the left and right sides of drawer so that when drawer is slidably inserted into the main unit, the weldment flanges positioned within the main tray receive the drawer mating lugs and maintain alignment of the device. in some embodiments, the drawer unit additionally comprises weldment lugs 270 affixed to the underside of the drawer unit at the outer peripheral edge of the drawer left and right side and which extend outward from the drawer unit so as to slidably engage the lower mating edge of the main tray unit when assembling and which maintain the insert tray in proper alignment.

Figure 6:
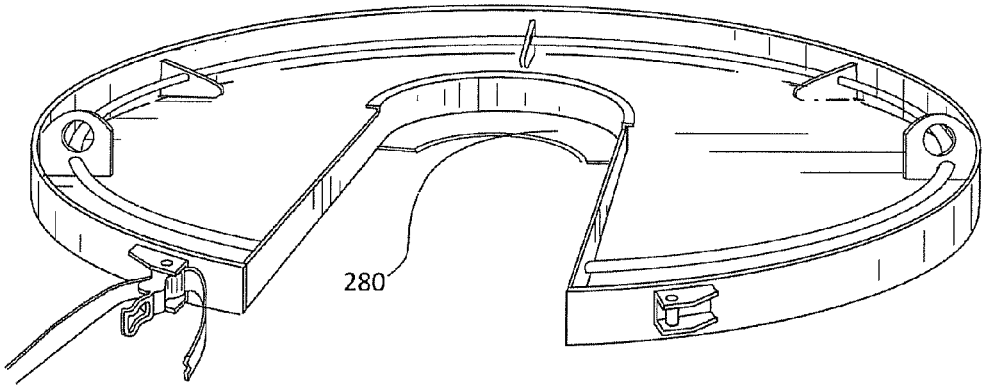
FIG. 6 shows a bird's-eye perspective view of a main portion 101 of the preferred embodiment of bop tray 100 shown in FIG. 1, with its secondary portion (drawer 102) removed, exposing wall 112 and associated mating flange 280 of the preferred embodiment

FIG. 6 shows the flange protrusion 280 as it exists on the main tray unit of one of the embodiments. This flange, in conjunction with a similar flange located at the inner annular margin of the drawer insert, aligns with and engages a slot formed upon the attachment of the device to external pipe flanges and provides extra stability to the unit in operation.

FIG. 7 shows the splash curtain in operation. Here, external ring 290 is attached to the drilling operation structure via c-clamps, zip ties or other means in such a position so that it is directly above the position of the tray device. Splash curtain 275 may be fashioned at the job site, or in some embodiments may be supplied as part of an installation kit and is attached at the upper ring and lower tray assembly via zip ties, clamps, or other means. Drain hose 295 is attached to one of multiple drain ports which in the preferred embodiment comprise four-inch NPT pipe fittings 106.

Figure 8:
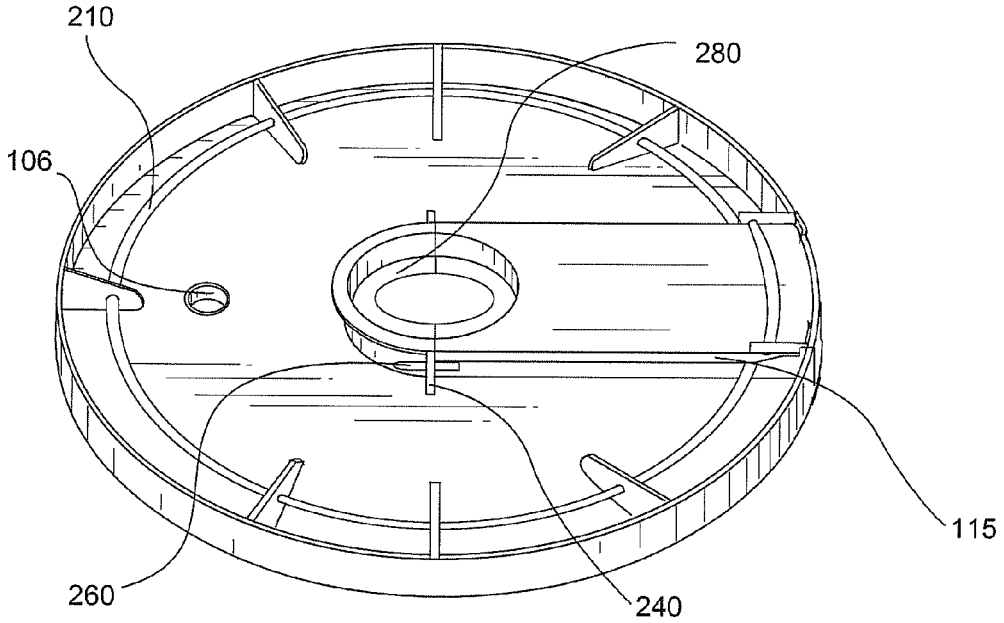
FIG. 8 shows a bird's-eye view of tray 100, offset at ninety-degrees as compared to the view of FIG. 1, to help depict the tongue and groove 115 in the overall context of bop tray 100.

FIG. 8 shows a 90 degree bird's-eye view of main tray 101, offset at 90 degrees as compared to the view of FIG. 1, to help depict the tongue and groove 115. In the preferred illustrated embodiment the insert functions as an inverted drawer, where the insert functions to cap the radial receiving slot of the main unit. However, a person of skill in the art would immediately recognize that the insert may comprise other configurations, such as a pan type assembly with side walls mating with the walls of the unit. Flange 280 of one embodiment of the device is shown in the assembled tray configuration with the two halves of said flange comprising a circular ring extending from the perimeter of the inner annulus of the combined tray assembly. In operation, the flanges of the tray component are inserted into the groove created between two assembled pipe flanges and lend stability to the assembled device.

In the illustrated embodiment, alignment pin 260 is welded to the inverted drawer tray and inserts into alignment lug 240 which is welded to the main tray in such a configuration to receive said alignment pin and, in combination with lower drawer lug alignment pin 270 (FIGS. 4A and 4B) maintain drawer insert in the proper orientation and plane relative to the main tray unit.

As another example, it should be appreciated that closure element and/or the movable element may be substituted for instrument, rather than strap and buckle, the closure element may be satisfied by a mechanical lever or cam assembly. In still other variations and alternative embodiments, flexible straps could be substituted with a band of metal or other material. Moreover, hydraulic, pneumatic or other actuators may be combined to apply additional force for increasing the amount of closure around the wellhead.

Whether now known or later discovered, the reader should understand that there are countless other alternatives, variations and modifications of the many features of the various described and illustrated embodiments, both in structure and in operation. As one class of contemplated alternatives that still embrace many aspects of the invention, a drip tray essentially as illustrated herein can be used in other wellhead applications such as surrounding the casing of a service or pulling rig, positioned on the rig at an elevation beneath the point of pulling. Such alternatives, variations and modifications should be evident to one of ordinary skill in the art after careful and discerning review of the foregoing descriptions, particularly if they are also able to review all of the various systems and methods that have been tried in the public domain or otherwise described in the prior art. All such alternatives, variations and modifications are contemplated to fall within the scope of the present invention.

Many alternatives, variations, substitutions, equivalents and the like will be evident for varied applications of the teachings of the present invention. For instance, it is possible that analogous uses and benefits may be appreciated irrespective whether bop tray 100 is positioned directly on the wellhead pipe stem 501 or elsewhere. It is also possible that analogous uses and benefits may be appreciated irrespective whether bop tray 100 or other aspects of the invention are used around the wellhead pipe stem of drilling rigs or service rigs or, for that matter, transport barges or other applications. Accordingly, to the extent structures or methods are captured within the spirit of the claims and their equivalents, the invention should not be limited by the foregoing descriptions.

In all respects, it should also be understood that the drawings and detailed descriptions of numerous embodiments herein are provided by way of example only and are to be regarded in an illustrative rather than in a restrictive manner. Such drawings and descriptions of the examples are not intended to limit the systems and methods of the present invention. Rather, the present invention includes all articles, systems and processes within the scope and spirit of the invention as claimed, as the claims may be amended, replaced or otherwise modified during the course of related prosecution. Any current, amended, or added claims should be interpreted to embrace all further modifications, changes, rearrangements, substitutions, alternatives, design choices, and embodiments that may be evident to those of skill in the art, whether now known or later discovered. In any case, all substantially equivalent variations should be considered within the scope of the invention and, absent express indication otherwise, all structural or functional equivalents are anticipated to remain within the spirit and scope of the disclosed system and method.

I claim:

1. A multi-component, easily-installable bop tray assembly for use in the containment of liquids which are discharged from the wellhead of an oil drilling operation and which may be used above an annular high drill of a blowout-preventer device, of the type commonly used in routine hydrocarbon drilling operations, comprising:

a. a tray with an upturned surface, said upturned surface defining a containment space for containing wellhead liquids;

b. a partial inner annulus integral with said tray, said partial inner annulus being adapted to circumferentially embrace a pipe stem of said wellhead, said partial inner annulus having a substantially vertical surface so as to, in conjunction with said upturned surface, further define said containment space for containing liquids;

c. a movable closure member engageable with said tray, wherein the movable closure member combines with said tray to form a sub-component of an annular structure surrounding said pipe stem;

d. said tray defining a slot or channel which is at least as wide as the diameter of said pipe stem and which is adapted so as to allow said tray to slide into place and largely surround said pipe stem, wherein the slot is defined by upturned walls which approximate the height of said upturned surface;

e. a closure element that engages the movable closure member to reduceably define an aperture;

f. a strap, cable or other closure for maintaining the closure member in a slidably engaged position relative to said tray by providing pressure at the outer periphery of said movable closure member sufficient to maintain said partial inner annulus in close proximity against said pipe stem, wherein said strap, cable or other closure is configured to provide leveraged closure for decreasing the opening of the aperture for said pipe stem.

2. The multi-component, easily installable tray assembly of claim 1 further comprising weldment lugs or other structure for lifting into position and mechanically securing the position of said tray, wherein:

a. said tray comprises a primary tray and a secondary tray; and b. said primary and secondary trays further comprise holes or fittings sufficient to drain fluid volumes contained in the tray assembly.

3. The multi-component, easily installable tray assembly of claim 2 wherein said primary tray further comprises a flange for receiving the edge margins of said secondary tray and aligning said secondary tray with said primary tray upon assembly.

4. The multi-component, easily installable tray assembly of claim 2 wherein said primary tray further comprises a lug, pin or other device along the lower exterior floor for receiving a mating lug, pin or other device affixed to the lower exterior floor of said secondary tray and which, when said secondary tray is inserted into the receiving slot of said primary tray in the assembled position, engages the mating lug, pin or other device of said secondary tray to maintain vertical alignment of the assembly.

5. The multi-component easily installable tray assembly of claim 1 wherein the upturned surface is substantially perpendicular to the floor of the tray assembly.

6. The multi-component, easily installable tray assembly of claim 1 wherein the tray assembly is comprised of sheet aluminum.

7. The multi-component, easily installable tray assembly of claim 6 wherein the sheet aluminum is at least ⅛ inch thick.

8. The multi-component, easily installable tray assembly of claim 1 wherein the diameter of the assembled device is between 4 and 10 feet.

9. The multi-component, easily installable tray assembly of claim 1 wherein the diameter of the assembled device is 6 to 8 feet.

10. The multi-component, easily installable tray assembly of claim 1 wherein the sides of the outer periphery of the assembled unit are between 1 inch and 12 inches high.

11. The multi-component, easily installable tray assembly of claim 1 wherein the sides of the outer periphery of the assembled unit are between 3 and 6 inches high.

12. The multi-component, easily installable tray assembly of claim 1, further comprising a primary tray and a secondary tray wherein said secondary tray further comprises a U-channel formed in the outer edge of said secondary tray and wherein said U-channel engages the upturned walls of the tray slot.

13. The multi-component, easily installable tray assembly of claim 12 wherein said secondary tray further comprises a horizontal sheet component, wherein said horizontal sheet component comprises a cap which traverses and covers the tray slot.

14. The multi-component, easily installable tray assembly of claim 1, further comprising a primary tray and a secondary tray, said primary tray comprises a tray slot, and wherein said secondary tray is functionally inverted so as to form a cap which covers the tray slot.

15. The multi-component, easily installable tray assembly of claim 14 wherein the peripheral edges of said secondary tray comprise a channel for receiving the side wall edges of said primary tray.

16. The multi-component, easily installable tray assembly of claim 1 wherein the annular structure surrounding said pipe stem of the completed assembly further comprises an insert or inserts which adjust the effective size of the annulus to fit well head pipe of differing diameter.

17. The multi-component, easily installable tray assembly of claim 16 wherein said inserts are composed of Ultra High Molecular Weight polyethylene.

18. The multi-component, easily installable tray assembly of claim 16 wherein said insert or inserts are comprised of 2 or more subunits which are assembled to form a completed unit.

19. The multi-component, easily installable tray assembly of claim 1 wherein the annular structure surrounding said pipe stem further comprises a means for sealing the assembly against a pipe, a well head casing or a blow-out preventer.

20. The multi-component, easily installable tray assembly of claim 19 wherein the sealing means comprises an o-ring section.

21. The multi-component, easily installable tray assembly of claim 19 wherein the sealing means comprises a sealing compound such as silicone.

22. The multi-component, easily installable tray assembly of claim 19 wherein the sealing means comprises a rubber skirt.

23. The multi-component, easily installable tray assembly of claim 22 wherein the rubber skirt further comprises a band between 1 to 4 inches wide and ⅛ to ½ inches thick.

24. The multi-component, easily installable tray assembly of claim 1 wherein the tray assembly further comprises lugs or other attachment points for the attachment of a protective curtain to further contain and direct fluids into the tray assembly.

25. The multi-component, easily installable tray assembly of claim 1 further comprising a primary tray and a secondary tray, wherein:

a. said secondary tray comprises a flange along the lower surface;

b. said primary tray comprises a slotted groove; and c. said flange slides along and aligns said secondary tray with the slotted groove of said primary tray.

26. The multi-component, easily installable tray assembly of claim 25 wherein said secondary tray is further comprised of horizontal channels at the lower edges extending from outer to inner edge margins and which engage a corresponding flange or mating groove on said primary tray.

* * * * *